US010323551B2

(12) United States Patent
Gunnarsson et al.

(10) Patent No.: US 10,323,551 B2
(45) Date of Patent: Jun. 18, 2019

(54) COMBUSTION ENGINE, VEHICLE COMPRISING THE COMBUSTION ENGINE AND METHOD FOR CONTROLLING THE COMBUSTION ENGINE

(71) Applicant: Scania CV AB, Södertälje (SE)

(72) Inventors: Niclas Gunnarsson, Huddinge (SE); Cedric Nyberg, Solna (SE); Eric Olofsson, Stockholm (SE)

(73) Assignee: SCANIA CV AB, Södertälje (SE)

( * ) Notice: Subject to any disclaimer, the term of this patent is extended or adjusted under 35 U.S.C. 154(b) by 0 days.

(21) Appl. No.: 15/039,746

(22) PCT Filed: Dec. 3, 2014

(86) PCT No.: PCT/SE2014/051441
§ 371 (c)(1),
(2) Date: May 26, 2016

(87) PCT Pub. No.: WO2015/084243
PCT Pub. Date: Jun. 11, 2015

(65) Prior Publication Data

US 2017/0002702 A1 Jan. 5, 2017

(30) Foreign Application Priority Data

Dec. 5, 2013 (SE) ..... 1351445

(51) Int. Cl.
*F02B 75/02* (2006.01)
*F01L 13/06* (2006.01)
(Continued)

(52) U.S. Cl.
CPC ..... *F01L 13/06* (2013.01); *F01L 1/047* (2013.01); *F01L 1/344* (2013.01); *F02B 75/02* (2013.01);
(Continued)

(58) Field of Classification Search
CPC . F01L 13/06; F01L 1/047; F01L 1/344; F02B 75/02; F02B 2075/027; F02D 13/0249; F02D 13/0273; F02D 13/04
(Continued)

(56) References Cited

U.S. PATENT DOCUMENTS 4,592,319 A * 6/1986 Meistrick ..... F01L 13/065 123/198 DB
4,981,119 A * 1/1991 Neitz ..... F02M 26/01 123/321
(Continued)

FOREIGN PATENT DOCUMENTS

FR 2922955 A1 5/2009
WO WO-00/61930 A1 10/2000
WO WO-2004/059131 A2 7/2004

OTHER PUBLICATIONS

International Search Report for PCT/SE2014/051441 dated Jun. 5, 2015.
(Continued)

*Primary Examiner* — Hung Q Nguyen
*Assistant Examiner* — Anthony Donald Taylor, Jr.
(74) *Attorney, Agent, or Firm* — Moore & Van Allen PLLC; W. Kevin Ransom

(57) ABSTRACT

A method to control a four-stroke combustion engine, comprising at least one cylinder; a piston arranged in each cylinder; at least one inlet valve arranged in each cylinder which is connected with an inlet system; at least one first camshaft which controls each inlet valve; at least one exhaust valve arranged in each cylinder which is connected with an exhaust system; at least one second camshaft which controls each exhaust valve; and a crankshaft which controls each camshaft. At least one phase-shifting device is arranged between the crankshaft and the second camshaft, to phase-shift the second camshaft in relation to the crankshaft to a
(Continued)

state, where the exhaust valve is controlled in such a way, that it is opened during the expansion stroke of the engine and closed during the exhaust stroke of the engine, to achieve engine braking through compression in the cylinders during the exhaust stroke.

20 Claims, 4 Drawing Sheets

(51) Int. Cl.
*F02D 13/02* (2006.01)
*F02D 13/04* (2006.01)
*F01L 1/047* (2006.01)
*F01L 1/344* (2006.01)

(52) U.S. Cl.
CPC ..... *F02D 13/0249* (2013.01); *F02D 13/0273* (2013.01); *F02D 13/04* (2013.01); *F02B 2075/027* (2013.01)

(58) Field of Classification Search
USPC ..... 123/315
See application file for complete search history.

(56) References Cited

U.S. PATENT DOCUMENTS 5,146,890 A * 9/1992 Gobert ..... F02D 13/04 123/321
5,172,610 A * 12/1992 Uzawa ..... B60W 10/06 477/47
5,746,175 A * 5/1998 Hu ..... F01L 9/021 123/322
5,934,263 A * 8/1999 Russ ..... F01L 1/34 123/568.14
6,129,061 A * 10/2000 Okuda ..... F01L 1/352 123/90.17
6,161,521 A * 12/2000 Russ ..... F01L 1/34 123/324
6,213,067 B1 * 4/2001 Takahashi ..... F01L 1/34 123/90.15
6,216,667 B1 * 4/2001 Pekar ..... F01L 13/06 123/320
6,354,254 B1 * 3/2002 Usko ..... F01L 13/06 123/321
6,367,435 B1 * 4/2002 Okui ..... F01L 1/02 123/90.15
6,405,694 B2 * 6/2002 Sato ..... F01L 1/34 123/90.15
6,418,720 B1 * 7/2002 Cornell ..... F01L 13/065 123/321
6,513,471 B1 * 2/2003 Hicks ..... F01L 1/34 123/90.16
7,063,056 B2 * 6/2006 Nakai ..... F01L 1/34 123/90.15
7,308,875 B2 * 12/2007 Murata ..... F02B 29/083 123/348
8,042,504 B2 * 10/2011 Berger ..... F01L 1/34406 123/347
8,327,619 B2 * 12/2012 Persson ..... F02D 17/02 123/90.15
8,360,021 B2 * 1/2013 Toda ..... F01L 1/3442 123/346
8,936,006 B2 * 1/2015 Groth ..... F01L 1/18 123/321
9,032,923 B2 * 5/2015 Yoshika ..... F01L 1/047 123/90.17
2011/0197839 A1 8/2011 Yoshika et al.
2011/0219767 A1 * 9/2011 Miyashita ..... F01L 1/267 60/600
2012/0024260 A1 2/2012 Groth et al.
2014/0182535 A1 * 7/2014 Roth ..... F02D 13/0284 123/90.15

OTHER PUBLICATIONS

Written Opinion of the International Searching Authority for PICT/SE2014/051441 dated Jun. 5, 2015.
Korean Office Action for Korean Patent Application No. 10-2016-7018047 dated May 1, 2018.

* cited by examiner

COMBUSTION ENGINE, VEHICLE COMPRISING THE COMBUSTION ENGINE AND METHOD FOR CONTROLLING THE COMBUSTION ENGINE

CROSS-REFERENCE TO RELATED APPLICATIONS

This application is a national stage application (filed under 35 § U.S.C. 371) of PCT/SE2014/051441, filed Dec. 3, 2014 of the same title, which, in turn, claims priority to Swedish Application No. 1351445-0, filed Dec. 5, 2013 of the same title; the contents of each of which are hereby incorporated by reference.

FIELD OF THE INVENTION

The present invention pertains to control of a combustion engine.

BACKGROUND OF THE INVENTION

In connection with engine braking of a vehicle, the throttle and fuel supply to the combustion engine are shut off. When the air in the cylinders is compressed during the compression stroke, the pistons will, via the rods, exert a braking torque on the crankshaft, which during the engine brake process is operated by the vehicle's driving wheels via driving shafts, a propeller shaft and the transmission. Since the crankshaft is directly connected with the vehicle's driving wheels during the engine-braking process, the braking torque from pistons and rods, affecting the crankshaft, will therefore brake the vehicle during engine braking.

In order to reinforce the effect of the engine brake, the exhaust valves may be deactivated, so that they remain closed during the exhaust stroke. The air in the cylinders will thus be compressed also during the exhaust stroke, entailing that the braking torque from the pistons and rods, affecting the crankshaft, also arises during the exhaust stroke.

In order to utilize the braking energy in connection with engine braking, the pressure of the air compressed in the cylinders must be reduced at the end of each compression. This is carried out with a decompression device that controls the exhaust valves, so that they are opened at the end of the compression stroke and at the end of the expansion stroke. Therefore, the air compressed in the cylinders will leave the cylinder via the exhaust channels and further along through the exhaust system. The decompression device subsequently closes the exhaust valves, so that air may be sucked in through the inlet valves and an overpressure may be built up in the cylinders during the next compression.

When the exhaust valves are deactivated during the exhaust stroke, a very high pressure arises in the cylinders. When the subsequent inlet stroke is initiated, it is important that the high pressure in the cylinders has been reduced with the help of the decompression device before the inlet valves are opened. In the event the pressure in the cylinders exceeds a certain level as the inlet valves are opened, the inlet valves and the drivetrain connected to the inlet valves may fail, because of the substantial force which the inlet valves and its drivetrain must overcome in order to open the inlet valves in the cylinder.

In a combustion engine comprising several cylinders, it is possible to control the braking torque during engine braking, by controlling the deactivation of the exhaust valves and controlling the decompression device for each cylinder. For example, by deactivating the exhaust valves and activating the decompression device in half of the engine's cylinders, the braking torque will be halved. It is also possible to deactivate the exhaust valves in any number of the engine's cylinders. Control may thus be carried out in steps, wherein the number of controllable steps depends on the number of cylinders in the engine.

Under certain operating conditions in the vehicle, it would be desirable to carry out the control of the engine braking torque steplessly, in order thus to be able to engine-brake the vehicle comfortably.

Document WO 2004059131 shows a system for engine braking in a combustion engine, wherein an exhaust valve is opened on several occasions during engine braking.

Document WO 2012038195 pertains to an engine-braking system for a combustion engine, wherein the opening and closing of the exhaust valves is brought forward in time, following which an opening of the exhaust valves takes place after the closing, with the objective of increasing the engine brake effect.

Document U.S. Pat. No. 6,394,067 shows a combustion engine with double camshafts, wherein the opening of the exhaust valve is brought forward in time during engine braking. The exhaust valve is subsequently only partly closed, in order to be fully closed before it is opened to reduce the pressure in the cylinders.

Document U.S. Pat. No. 3,234,923 describes a method and an engine braking system for a combustion engine. A phase shift of a camshaft to control exhaust valves results in engine braking. The phase shift is approximately 160 degrees on the crankshaft, which entails that the exhaust valves are opened at a crankshaft position, corresponding to the exhaust valve opening achieved by the decompression device, as discussed above.

SUMMARY OF THE INVENTION

Despite prior art solutions, there is a need to further develop a combustion engine, efficiently engine braking a vehicle by using compression during the exhaust stroke, at the same time as the risk of engine failure is reduced. There is also a need for steplessly controlling the size of the braking torque during engine braking.

The objective of the present invention is thus to provide a combustion engine, which efficiently engine-brakes a vehicle by using compression during the exhaust stroke.

Another objective of the invention is to provide a combustion engine, for which the risk of engine failure is reduced, when engine braking is carried out by using compression during the exhaust stroke.

Another objective of the invention is to provide a combustion engine, in which the size of the braking torque may be controlled steplessly during engine braking.

These objectives are achieved with a combustion engine of the type specified at the beginning, which is characterized by the features specified in claim 1.

In such a combustion engine, the risk of engine failure is reduced because the opening of the exhaust valves is phase-shifted instead of deactivated. At the same time, it is possible to control the braking torque by controlling the phase shift of the second camshaft, in order thus to control the second compression during the exhaust stroke. The size of the braking torque may thus be controlled steplessly during engine braking.

According to the invention, a decompression device is connected to the exhaust valves, which decompression device is adapted to open and close the exhaust valves in the transition area between an exhaust stroke and an inlet stroke, when the piston is at top dead center in the cylinder. By opening the exhaust valves in the transition area between an exhaust stroke and an inlet stroke, the pressure in the cylinders is reduced when the inlet valves are opened. The risk of engine failure is therefore reduced when engine-braking is carried out by using compression during the exhaust stroke.

According to one embodiment, the at least one phase-shifting device is also arranged between the crankshaft and the at least one first camshaft, in order to phase-shift the at least one first camshaft in relation to the crankshaft, to a position where the inlet valves are controlled in such a manner, that they open at a crank angle where the exhaust valves are closed with the decompression device. Phase-shifting of the inlet lifting during the engine braking entails that the pressure in the cylinder is reduced to a level, where the risk of the inlet valves and their drivetrain failing is reduced. At the same time, pressure pulses in the inlet pipe are avoided when the inlet valves open, which reduces the risk of noise arising in the combustion engine.

According to another embodiment, two inlet valves and two exhaust valves are arranged in each cylinder. In such a combustion engine the application of the invention will be very effective, since the number of valves per cylinder impacts the flow of air through the cylinders, which in turn impacts the adjustability of engine braking.

According to another embodiment, two first and two second camshafts are arranged in the combustion engine. Individual control of the inlet and exhaust valves is thus facilitated, impacting the adjustability of engine braking.

According to another embodiment, a phase-shifting device is arranged for each camshaft. By arranging a phase-shifting device for each camshaft, an effective phase shift of the camshafts may be achieved, increasing the adjustability of engine braking.

According to another embodiment, the combustion engine is a diesel engine. Since the diesel engine operates with compression ignition, cylinders, combustion chambers, pistons and valves may be adapted in such a way that a substantial phase shift of the camshafts, and thus the valve times, is achieved, while simultaneously a suitable geometry of the components interacting in the engine may be provided, so that a functioning interaction between pistons and valves is achieved.

The objectives specified above are also achieved with a vehicle of the type mentioned above, which is characterized by the features specified in claim 8. In a vehicle with such a combustion engine, an effective engine-braking of the vehicle may be achieved by using, with the phase shift of the opening and closing times of the exhaust valves, compression during the exhaust stroke, while simultaneously the risk of engine failure is reduced when engine braking is carried out through the use of compression during the exhaust stroke. The size of the braking torque may be controlled steplessly during engine braking, meaning that the driving comfort is in-creased.

The above objectives are achieved also with a method to control a combustion engine of the type specified at the beginning, which is characterized by the features specified in claim 9.

The method according to the present invention entails that the fuel supply to all the cylinders is closed, and that every second camshaft is phase-shifted in relation to the crankshaft, so that every second camshaft is phase-shifted to a state where the exhaust valves are controlled in such a way, that they are opened during the expansion stroke of the engine and closed during the exhaust stroke of the engine, in order to achieve engine braking through compression in the cylinders during the exhaust stroke. With such a method, the risk of engine failure is reduced, because the opening of the exhaust valves is phase-shifted instead of being deactivated. At the same time, it is possible to control the braking torque by controlling the phase shift of the second camshaft, in order thus to control the second compression during the exhaust stroke.

According to one embodiment, the at least one second camshaft is phase-shifted between −60° and −120° crankshaft degrees, preferably −90° crankshaft degrees. The at least one second camshaft will thus open early during the expansion stroke and initiate closing early during the exhaust stroke, with the objective of obtaining a compression during the exhaust stroke. The phase shift of the at least one second camshaft may be changed steplessly between 0 to −60 crankshaft degrees, according to some embodiments, and between 0 to −120 crankshaft degrees according to other embodiments.

According to another embodiment, the exhaust valves are opened and closed with a decompression device in the transition area between an exhaust stroke and an inlet stroke, where the piston is at a top dead center in the cylinder. By opening the exhaust valves in the transition area between an exhaust stroke and an inlet stroke, the pressure in the cylinders is reduced when the inlet valves are opened. Thus, the risk of engine failure is reduced when engine braking is carried out by using compression during the exhaust stroke.

According to another embodiment, the exhaust valves are opened with the decompression device 40°-80° crankshaft degrees, preferably 60° crankshaft degrees, before the top dead center between the exhaust stroke and the inlet stroke, and the exhaust valves are closed with the decompression device 40°-80° crankshaft degrees, preferably 60° crankshaft degrees, after the top dead center between the exhaust stroke and the inlet stroke. By opening the exhaust valves in the transition area between an exhaust stroke and an inlet stroke, the pressure in the cylinders is reduced when the inlet valves are opened. Thus, the risk of engine failure is reduced when engine braking is carried out by using compression during the exhaust stroke.

According to another embodiment, the decompression device is adapted to open and close the at least one exhaust valve in the transition area between an inlet stroke and an exhaust stroke, when the piston is at a top dead center in the cylinder.

According to another embodiment, two inlet valves and two exhaust valves per cylinder are controlled by the respective camshaft. In such a combustion engine the application of the invention will be very effective, since the number of valves per cylinder impacts the flow of air through the cylinders, which in turn impacts the adjustability of engine-braking.

According to another embodiment, each first camshaft is phase-shifted in relation to the crankshaft, so that each first camshaft is phase-shifted to a state where the inlet valves are controlled in such a way, that they are opened at a crankshaft angle where the exhaust valves are closed with the decompression device. Phase-shifting of the inlet lifting during the engine braking entails that the pressure in the cylinder is reduced to a level, where the risk of the inlet valves and their drivetrain failing is reduced. At the same time, pressure pulses in the inlet pipe are avoided when the inlet valves open, which reduces the risk of noise arising in the combustion engine.

According to another embodiment, the inlet valves are opened 20°-80° crankshaft degrees, preferably 50° crankshaft degrees, after the top dead center between the exhaust stroke and the inlet stroke. In such a phase shift the pressure in the cylinder is reduced to a level, which reduces the risk of the inlet valves and their drivetrain failing. At the same time, pressure pulses in the inlet pipe are avoided when the inlet valves open, which reduces the risk of noise arising in the combustion engine. The phase shift of the inlet valves may also be stepless according to some embodiments, e.g. between 0-20 crankshaft degrees, or 0-80 crankshaft degrees, after the top dead center between the exhaust stroke and the inlet stroke.

According to another embodiment, two exhaust valves per cylinder are controlled with the at least one second camshaft. In such a method the application of the invention will be very effective, since the number of valves per cylinder impacts the flow of air through the cylinders, which in turn impacts the adjustability of engine braking.

According to another embodiment, the combustion engine is operated with diesel. Since an engine operated with diesel works with compression ignition, cylinders, combustion chambers, pistons and valves may be designed in such a way, that a substantial phase-shifting of the camshafts, and thus the valve times, is achieved at the same time as a suitable geometry of the components interacting in the engine may be provided, so that a functioning interaction between pistons and valves is achieved.

Since substantially no negative pressure develops in the cylinders, no oil pumping from the crankcase to the cylinders occurs.

According to the invention, the combustion engine comprises a crankshaft, preferably a number of cylinders where each one has a forwards and backwards moving piston assembled inside, and is connected to the crankshaft for movement forwards and backwards, as well as a number of inlet and exhaust valves of disc type, in order to allow inlet air to come into the cylinders and to allow exhausts to leave the cylinders.

The inlet and exhaust valves are each controlled and operated by a camshaft, which in turn is operated by the crankshaft. Between the crankshaft and each camshaft, there is a phase-shifting device that controls the camshaft and thus the valves' opening and closing times in relation to the crankshaft. The phase-shifting device is preferably connected to a control device, which controls the phase-shifting device into a position adapted to the combustion engine's operating mode. The control device also controls a fuel injection device, delivering fuel to the cylinders.

When engine braking is applied, and the vehicle according to the present invention thus decelerates in speed, the control device will close the flow of fuel to the cylinders and adjust the phase-shifting device for each camshaft, so that no fuel is injected into the cylinders and a compression is obtained during the exhaust stroke.

According to the invention, the combustion engine preferably has separate camshafts for inlet and exhaust valves. At an operating mode corresponding to normal load in the combustion engine, the phase-shifting device for the camshaft is controlled in such a way, that the exhaust valves open at the bottom dead center for termination of the expansion stroke, and the inlet valves open at the top dead center when the inlet stroke is initiated.

In the absence of throttle to the engine and instructions that engine braking must be activated, the control device will close the fuel supply to the engine's cylinders and adjust the phase-shifting device to the camshafts, so that a compression is obtained during the exhaust stroke.

Other advantages of the invention are set out in the detailed description below.

BRIEF DESCRIPTION OF THE DRAWINGS

Below is a description, as an example, of preferred embodiments of the invention with reference to the enclosed drawings, in which.

DETAILED DESCRIPTION OF A PREFERRED EMBODIMENT OF THE INVENTION

Figure 1:
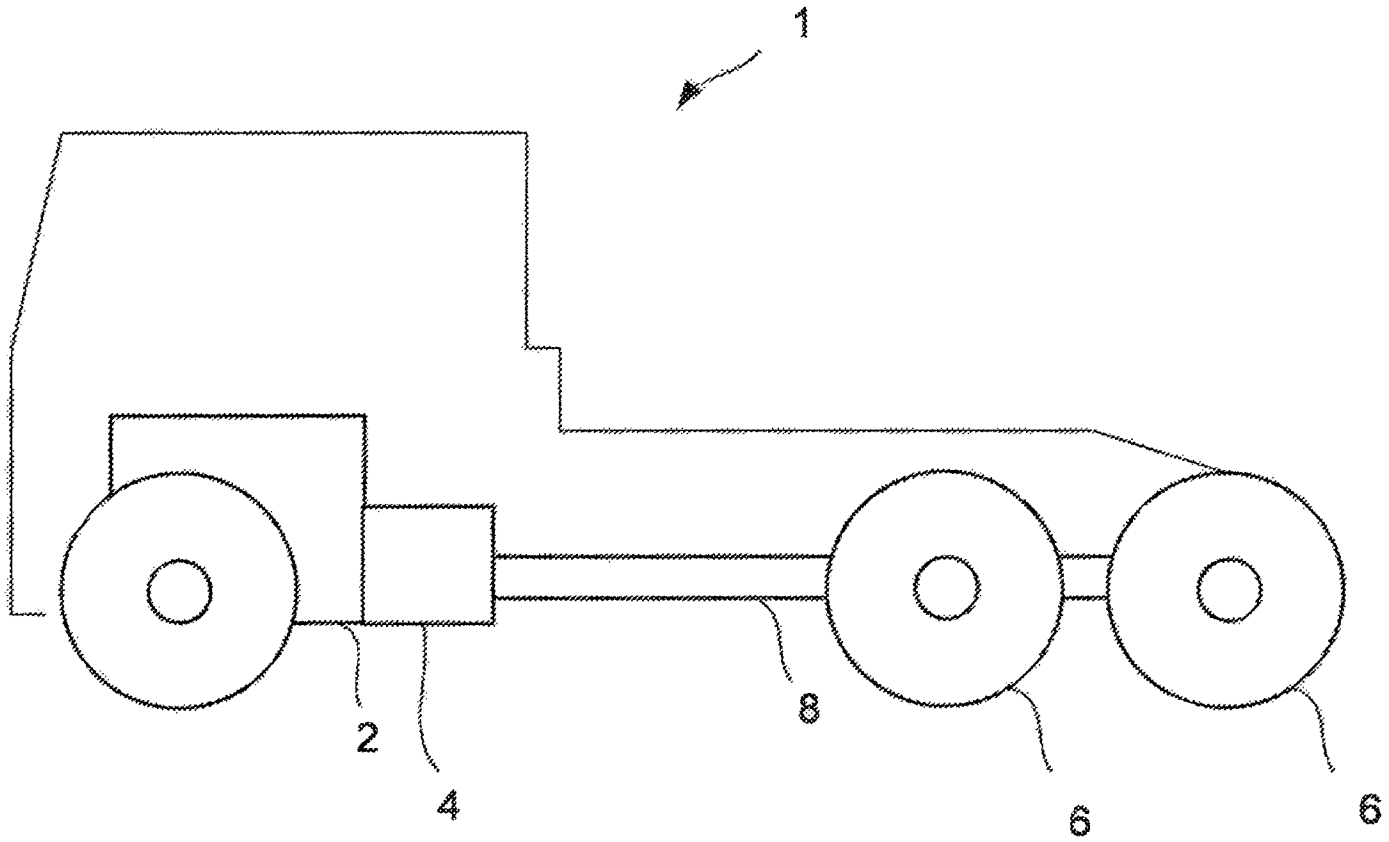
FIG. 1 is a side view of a schematically displayed vehicle, with a combustion engine according to the present invention.

FIG. 1 shows a schematic side view of a vehicle 1, which vehicle 1 is equipped with a four-stroke combustion engine 2 according to the present invention. The combustion engine 2 is preferably a diesel engine. The vehicle 1 is also equipped with a gearbox 4 connected to a combustion engine 2, driving the driving wheels 6 of the vehicle 1 via the gearbox 4, and a propeller shaft 8.

Figure 2:
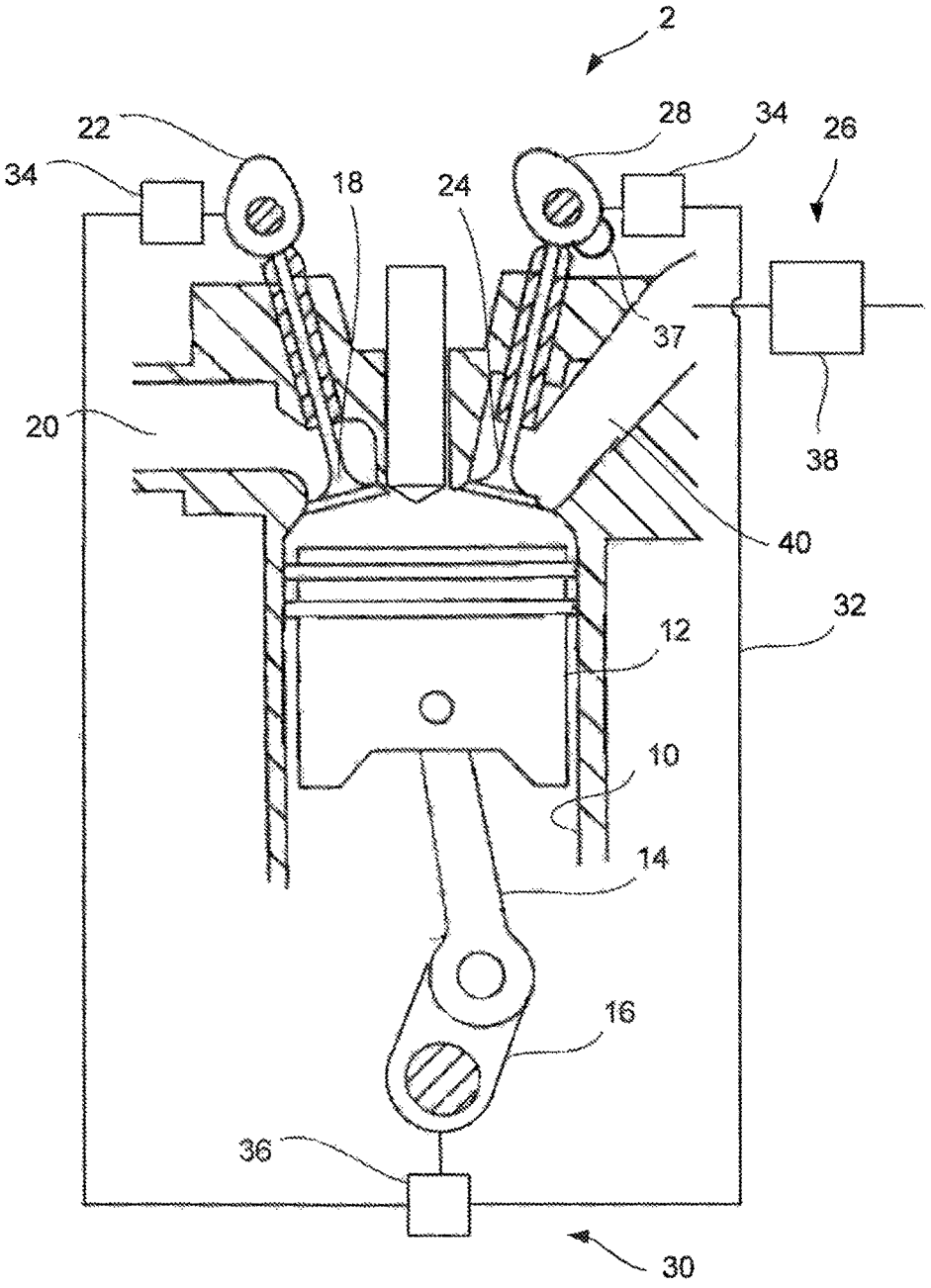
FIG. 2 is a cross-sectional view of a schematically displayed combustion engine according to the present invention.

FIG. 2 shows a cross-sectional view of a combustion engine 2 according to the present invention. The combustion engine 2 comprises at least one cylinder 10, with a piston 12 arranged in each cylinder 10. The piston 12 is connected via a connecting rod 14 to a crankshaft 16, which at rotation moves the piston 12 forwards and backwards in the cylinder 10. At least one inlet valve 18 is arranged in each cylinder 10, which inlet valve 18 is connected with an inlet system 20. At least one first camshaft 22 controls each inlet valve 18. At least one exhaust valve 24 is arranged in each cylinder 10, which exhaust valve 24 is connected with an exhaust system 26. Preferably, two inlet valves 18 and two exhaust valves 24 are arranged in each cylinder 10. At least one second camshaft 28 controls at least one exhaust valve 24. Depending on the type of combustion engine 2, two first and two second camshafts 22, 28 may be arranged in the combustion engine 2. This is advantageous if the engine 2 is of V-type. Preferably, the combustion engine has several cylinders.

A camshaft control 30 is arranged in the combustion engine 2 according to the present invention. The crankshaft 16 controls each camshaft 22, 28 via a camshaft transmission 32. At least one phase-shifting device 34 is arranged between the crankshaft 16 and each camshaft 22, 28, so that each camshaft 22, 28 may be phase-shifted to a desired angular position in relation to the angular position of the crankshaft. Preferably, a phase-shifting device 34 is arranged for each camshaft 22, 28. A control device 36 receives signals from a number of different sensors (not shown), such as absolute pressure in the inlet manifold, charge air temperature, mass airflow, throttle position, engine speed, engine load. The control device 36 operates the phase-shifting devices 34, which adjust the angle position of the camshafts 22, 28 in relation to the crankshaft 16. A decompression device 37 is connected to the exhaust valves 24, decompression device 37 is adapted to open and close the exhaust valves 24 in the transition area between an exhaust stroke and an inlet stroke, when the piston 12 is at top dead center in the cylinder 10. By opening the exhaust valves 24 in the transition area between an exhaust stroke and an inlet stroke, the pressure in the cylinders 10 is reduced when the inlet valves 18 are opened. The risk of engine failure is therefore reduced when engine braking is carried out by using compression during the exhaust stroke. The decompression device 37 is connected to the control device 36.

Figure 3:
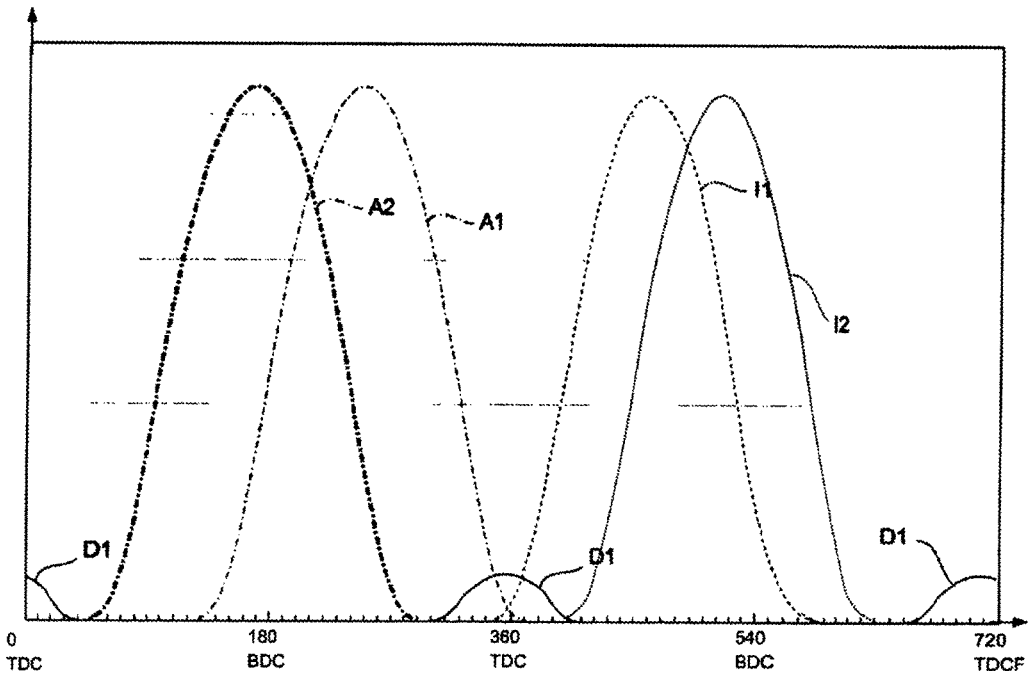
FIG. 3 shows a diagram of a phase shift of inlet and exhaust valves in a combustion engine according to the present invention.

FIG. 3 shows a graph representing a phase shift of inlet and exhaust valves 18, 24 in a combustion engine 2 according to the present invention. The Y-axis represents the distance that the inlet and exhaust valves 18, 24 move. The X-axis represents the angular movement of the crankshaft 16. The piston 12 moves between a top dead center, TDC, and a bottom dead center, BDC, in the cylinder 10. At e.g. 0°, the piston 12 is at the top dead center, TDC, and at 180° the piston 12 is at the bottom dead center, BDC. The graph in FIG. 3 represents a combustion engine 2 of four-stroke type, which entails that the crankshaft 16 and therefore the piston 12 will have moved 720° when all four strokes have been completed.

The curve A1 represents the movement of the exhaust valve 24 in relation to the piston movement at normal load. The curve 11 represents the movement of the inlet valve 18 in relation to the piston movement at normal load. FIG. 3 thus shows, through the curve A1, that the exhaust valve 24 at normal load opens at the end of the expansion stroke, i.e. at 120°, in order to release the exhausts to the exhaust and after-treatment system 38 during the exhaust stroke. The exhaust valve 24 then closes at the start of the inlet stroke, which occurs at 360°. Roughly at the same time, the inlet valve 18 opens, shown by the curve 11, in order to let air into the cylinder 10. The inlet valve 18 then closes at 590°, at which point the compression stroke is initiated. At 720°, corresponding to 0°, the expansion stroke is started.

The curve A2 illustrates a situation where the engine 2, and therefore the vehicle 1, are decelerated through engine braking according to the present invention, wherein the phase-shifting device 34 for the second camshaft 28 has been adjusted, so that the exhaust valves 24 open and close earlier than what would be the case with normal load. At the same time, the fuel supply to one or several of the cylinders 10 of the engine 2 is closed or restricted, so that no fuel, or a limited volume of fuel is injected into one or several of the cylinders 10. By phase-shifting the second camshaft 28 in relation to the crankshaft 16, so that every second camshaft 28 is phase-shifted to a state, where the exhaust valves 24 are controlled in such a way that they are opened during the expansion stroke of the engine and closed during the exhaust stroke of the engine, engine braking is achieved through compression in the cylinders 10 during the exhaust stroke. Preferably, the second camshaft 22 is phase-shifted between −60° and −120° crankshaft degrees, preferably −90° crankshaft degrees. Engine braking is thus obtained, since compression arises in the cylinders 10 during both the compression stroke and the exhaust stroke.

In order to utilize the braking energy at engine braking, the pressure of the air compressed in the cylinders 10 must be reduced at the end of each compression. The exhaust valves 24 are therefore opened and closed with the decompression device 37 in the transition area between an exhaust stroke and an inlet stroke, when the piston 12 is at a top dead center in the cylinder 10. The air compressed in the cylinders 10 will therefore leave the cylinders 10 through the exhaust channels and further along through the exhaust system. The decompression device 37 subsequently closes the exhaust valves 24, so that air may be sucked in through the inlet valves 18, and an overpressure may be built up in the cylinders 10 at the next compression. With the decompression device the exhaust valves 24 are opened 40°-80° crank-shaft degrees, preferably 60° crankshaft degrees, before the top dead center between the exhaust stroke and the inlet stroke, and the exhaust valves 24 are closed with the decompression device 40°-80°, preferably 60°, after the top dead center between the exhaust stroke and the inlet stroke. The opening and closing of the exhaust valves 24 with the decompression device 37 is shown by the curves D1 in FIG. 3.

FIG. 3 and the curves D1 thus show that the decompression device 37 may also open and close the exhaust valves 24 in the transition area between an inlet stroke and an exhaust stroke when the piston 12 is at a top dead center in the cylinder 10. The air compressed in the cylinders 10 will therefore leave the cylinders 10 through the exhaust channels and further along through the exhaust system. With the decompression device, the exhaust valves 24 are opened 50°-90° crankshaft degrees, preferably 70° crankshaft degrees, before the top dead center between the inlet stroke and the exhaust stroke, and the exhaust valves 24 are closed with the decompression device 20°-60°, preferably 40°, after the top dead center between the inlet stroke and the exhaust stroke.

By opening the exhaust valves 24 in the transition area between an exhaust stroke and an inlet stroke, the pressure in the cylinders 10 is reduced when the inlet valves 18 are opened. Thus, the risk of engine failure reduced when engine braking is carried out by using compression during the exhaust stroke. In order to further reduce the risk of the inlet valves 18 opening at too high a pressure in the cylinders 10, the first camshaft 22 is phase-shifted in relation to the crankshaft 16, so that the first camshaft 22 is phase-shifted to a state, where the inlet valves 18 are controlled in such a way, that they are opened at a crankshaft degree where the exhaust valves 24 are closed with the decompression device. The first camshaft 22 is phase-shifted to a state where the inlet valves are opened 20°-80° crankshaft degrees, preferably 50° crankshaft degrees, after the top dead center between the exhaust stroke and the inlet stroke, as shown by the curve 12 in FIG. 3. Phase-shifting of the inlet lifting during the engine braking entails, that the pressure in the cylinders 10 is reduced to a level where the risk of the inlet valves 18 and their drivetrain failing is reduced. At the same time, pressure pulses in the inlet pipe are avoided when the inlet valves 18 open, which reduces the risk of noise arising in the combustion engine 2.

Figure 4:
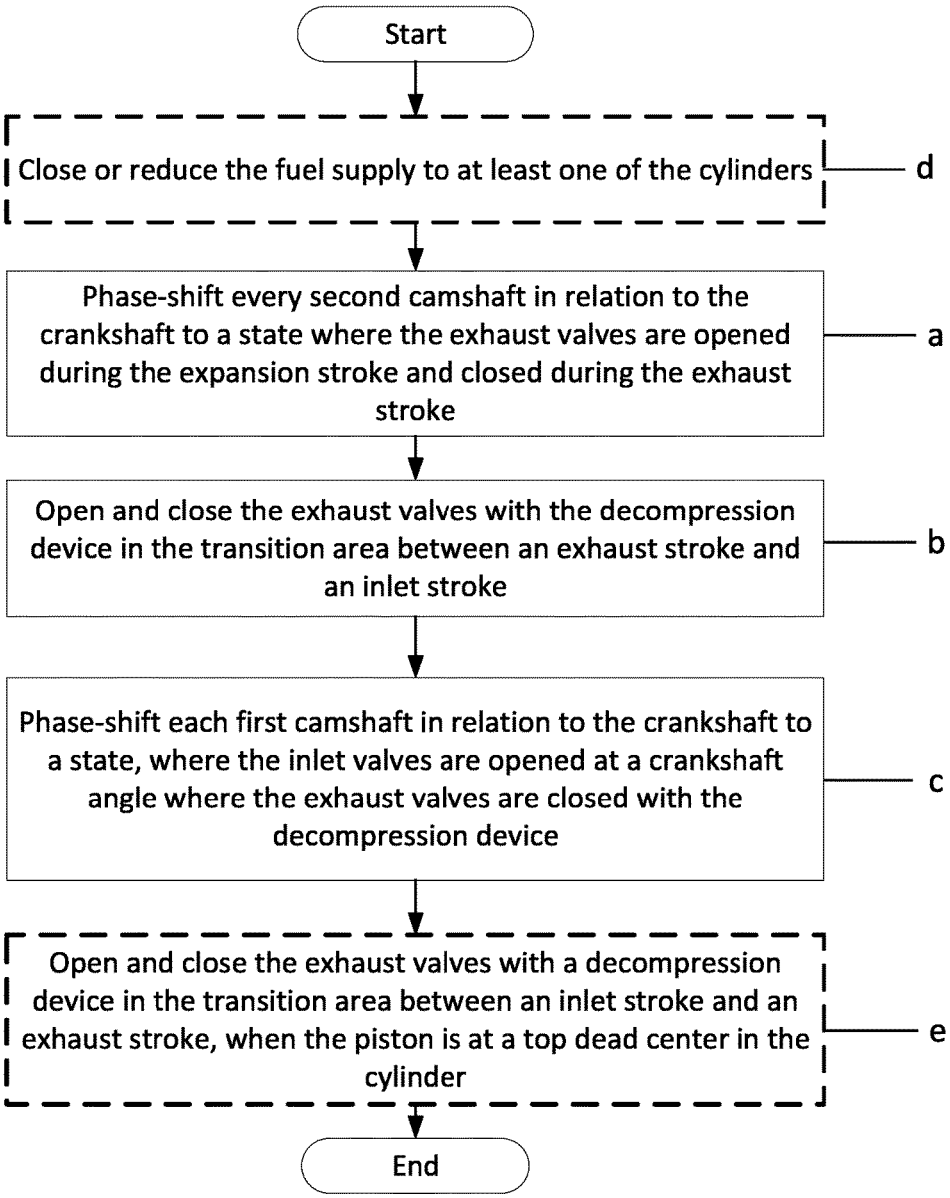
FIG. 4 shows a flow chart of a method to control a combustion engine according to the present invention.

The method to control the combustion engine 2 according to the present invention will be described below jointly with the flow chart in FIG. 4, which method comprises the steps:
a) to phase-shift every second camshaft 28 in relation to the crankshaft 16, so that every second camshaft 28 is phase-shifted to a state, where the exhaust valves 24 are controlled in such a way, that they are opened during the expansion stroke of the engine and closed during the exhaust stroke of the engine, to achieve engine-braking through compression in the cylinders 10 during the exhaust stroke.

According to one embodiment of the invention, the at least one second camshaft 22 is phase-shifted in step a), representing −60° to −120° crankshaft degrees, preferably −90° crankshaft degrees.

The method also comprises the additional step:
b) to open and close the exhaust valves with the decompression device in the transition area between an exhaust stroke and an inlet stroke, where the piston 12 is at a top dead center in the cylinder 10.

According to one embodiment of the invention, the phase shift of every second camshaft may be controlled in order to thus control the second compression during the exhaust stroke, for achieving stepless control of the size of the braking torque during engine braking.

According to one embodiment of the invention, in step b) the exhaust valves are opened with the decompression device 40°-80° crankshaft degrees, preferably 60° crankshaft degrees, before the top dead center between the exhaust stroke and the inlet stroke, and the exhaust valves are closed with the decompression device 40°-80°, preferably 60°, after the top dead center between the exhaust stroke and the inlet stroke.

The method also comprises the additional step:

c) to phase-shift each first camshaft 22 in relation to the crankshaft 16, so that each first camshaft 22 is phase-shifted to a state, where the inlet valves 18 are controlled in such a way, that they are opened at a crankshaft angle where the exhaust valves are closed with the decompression device.

According to one embodiment of the invention, in step c) the inlet valves are opened 20°-80° crankshaft degrees, preferably 50° crankshaft degrees, after the top dead center between the exhaust stroke and the inlet stroke.

According to one embodiment of the invention, in step a) two exhaust valves 24 per cylinder are controlled with the at least one second camshaft 28.

According to one embodiment of the invention, in step a) each exhaust valve 24 is controlled with two second camshafts 28.

According to one embodiment of the invention, every second camshaft 28 is phase-shifted in step a) with a phase-shifting device 34, arranged for every second camshaft 28.

According to one embodiment of the invention, the method before step a) comprises the additional step:

d) to close or reduce the fuel supply to at least one of the cylinders 10.

According to one embodiment of the invention, the combustion engine 2 is powered with diesel fuel.

According to one embodiment of the invention, the method comprises the additional step:

e) to open and close the at least one exhaust valve 24 with a decompression device in the transition area between an inlet stroke and an exhaust stroke, when the piston 12 is at a top dead center in the cylinder 10.

The components and features specified above may, within the framework of the invention, be combined between different embodiments specified.

The invention claimed is:

1. A four-stroke combustion engine comprising:

at least one cylinder;

a piston arranged in the at least one cylinder, wherein said piston is connected via a connecting rod to a crankshaft;

at least one inlet valve arranged in the at least one cylinder, wherein the at least one inlet valve is connected with an inlet system;

at least one first camshaft, wherein said at least one first camshaft is in operable contact with the at least one inlet valve;

at least one exhaust valve arranged in the at least one cylinder, wherein the at least one exhaust valve is connected with an exhaust system;

at least one second camshaft in operable contact with the at least one exhaust valve, such that the at least one second camshaft controls the at least one exhaust valve using a valve lift profile designed to open the at least one exhaust valve during an exhaust stoke of the engine to release exhaust gas from the at least one cylinder;

wherein the crankshaft is in operable contact with and is configured to control each of said at least one first camshaft and at least one second camshaft;

at least one cam phase-shifting device arranged between the crankshaft and the at least one second camshaft, such that the at least one cam phase-shifting device is configured to phase-shift the at least one second camshaft in relation to the crankshaft, to a state where the valve lift profile for the at least one exhaust valve is altered such that the at least one exhaust valve is opened during an expansion stroke of the engine and closed during the exhaust stroke of the engine, in order to achieve engine-braking via compression in the at least one cylinder during the exhaust stroke of the engine; and a decompression device positioned between the at least one second camshaft and the at least one exhaust valve, such that after phase-shifting the at least one second camshaft, the decompression device is arranged to contact the at least one exhaust valve and further alter the valve lift profile for the at least one exhaust valve, such that the at least one exhaust valve is controlled to open and close in a transition area between the exhaust stroke of the engine and an inlet stroke of the engine, when the piston is at a top dead center in the at least one cylinder.

2. The combustion engine according to claim 1, wherein the phase-shift of the at least one second camshaft is controlled, to thereby control the compression in the at least one cylinder during the exhaust stroke of the engine, for achieving stepless control of a size of an amount of braking torque during engine braking.

3. The combustion engine according to claim 1, wherein the phase-shift of the at least one second camshaft takes place between −60 and −120 crankshaft degrees.

4. The combustion engine according to claim 1, wherein the at least one cam phase-shifting device is also arranged between the crankshaft and the at least one first camshaft, to phase-shift the at least one first camshaft in relation to the crankshaft to a state, where the at least one inlet valve is controlled in such a way, that said at least one inlet valve is opened at a crankshaft angle where the at least one exhaust valve is closed with the decompression device.

5. The combustion engine according to claim 1, wherein the decompression device is adapted to open and close the at least one exhaust valve in another transition area between the inlet stroke of the engine and the exhaust stroke of the engine, when the piston is at the top dead center in the at least one cylinder.

6. The combustion engine according to claim 1, wherein the combustion engine further comprises two inlet valves and two exhaust valves arranged in the at least one cylinder.

7. The combustion engine according to claim 1, wherein the combustion engine further comprises two first camshafts and two second camshafts arranged in the combustion engine.

8. The combustion engine according to claim 1, wherein the at least one phase-shifting device comprises first and second cam phase-shifting devices that are arranged for each of the at least one first camshaft and the at least one second camshaft, respectively.

9. A vehicle, comprising a four-stoke combustion engine, said combustion engine comprising:

at least one cylinder;

a piston arranged in the at least one cylinder, wherein said piston is connected via a connecting rod to a crankshaft;

at least one inlet valve arranged in the at least one cylinder, wherein the at least one inlet valve is connected with an inlet system;

at least one first camshaft, wherein said at least one first camshaft is in operable contact with the at least one inlet valve;

at least one exhaust valve arranged in the at least one cylinder, wherein the at least one exhaust valve is connected with an exhaust system;

at least one second camshaft in operable contact with the at least one exhaust valve, such that the at least one second camshaft controls the at least one exhaust valve using a valve lift profile designed to open the at least one exhaust valve during an exhaust stroke of the engine to release exhaust gas from the at least one cylinder;

wherein the crankshaft is in operable contact with and is configured to control each of said at least one first camshaft and at least one second camshaft;

at least one cam phase-shifting device arranged between the crankshaft and the at least one second camshaft, such that the at least one cam phase-shifting device is configured to phase-shift the at least one second camshaft in relation to the crankshaft, to a state where the valve lift profile for the at least one exhaust valve is altered such that the at least one exhaust valve is opened during an expansion stroke of the engine and closed during the exhaust stroke of the engine, in order to achieve engine-braking via compression in the at least one cylinder during the exhaust stroke of the engine; and a decompression device positioned between the at least one second camshaft and the at least one exhaust valve, such that after phase-shifting the at least one second camshaft, the decompression device is arranged to contact the at least one exhaust valve and further alter the valve lift profile for the at least one exhaust valve, such that the at least one exhaust valve is controlled to open and close in a transition area between the exhaust stroke of the engine and an inlet stroke of the engine, when the piston is at a top dead center in the at least one cylinder.

10. A method to control a four-stroke combustion engine, wherein the combustion engine comprises:

at least one cylinder;

a piston arranged in the at least one cylinder, wherein said piston is connected via a connecting rod to a crankshaft;

at least one inlet valve arranged in the at least one cylinder, wherein the at least one inlet valve is connected with an inlet system;

at least one first camshaft, wherein said at least one first camshaft is in operable contact with the at least one inlet valve;

at least one exhaust valve arranged in the at least one cylinder, wherein the at least one exhaust valve is connected with an exhaust system;

at least one second camshaft in operable contact with the at least one exhaust valve, such that the at least one second camshaft controls the at least one exhaust valve using a valve lift profile designed to open the at least one exhaust valve during an exhaust stroke of the engine to release exhaust gas from the at least one cylinder;

wherein the crankshaft is in operable contact with and is configured to control each of said at least one first camshaft and at least one second camshaft, wherein the method comprises:

a) phase-shifting the at least one second camshaft in relation to the crankshaft, such that the at least one second camshaft is phase-shifted to a state, where the valve lift profile for the at least one exhaust valve is altered such that the at least one exhaust valve is opened during an expansion stroke of the engine and closed during the exhaust stroke of the engine, in order to achieve engine-braking via compression in the at least one cylinders during the exhaust stroke of the engine; and b) further altering the valve lift profile for the at least one exhaust valve with a decompression device, said decompression device positioned between the at least one second camshaft and the at least one exhaust valve, such that the at least one exhaust valve is controlled to open and close in a transition area between the exhaust stroke of the engine and an inlet stroke of the engine, when the piston is at a top dead center in the at least one cylinder.

11. The method according to claim 10, wherein the phase-shifting of the at least one second camshaft is controlled, to thereby control the compression in the at least one cylinder during the exhaust stroke of the engine, for achieving stepless control of a size of an amount of braking torque during engine braking.

12. The method according to claim 10, wherein the phase-shifting of the at least one second camshaft takes place between −60 and −120 crankshaft degrees.

13. The method according to claim 10, wherein the opening of the at least one exhaust valve with the decompression device takes place between 40 and 80 crankshaft degrees, before the top dead center between the exhaust stroke of the engine and the inlet stroke of the engine; and the closing of the at least one exhaust valve with the decompression device takes place between the exhaust stroke of the engine and the inlet stroke of the engine.

14. The method according to claim 13, further comprising:

c) phase-shifting the at least one first camshaft in relation to the crankshaft, such that the at least one first camshaft is phase-shifted to a state, where the at least one inlet valve is controlled in such a way, that said at least one inlet valve is opened at a crankshaft angle where the at least one exhaust valve is closed with the decompression device.

15. The method according to claim 14, wherein the at least one inlet valve is opened between 20 and 80 crankshaft degrees, after the top dead center between the exhaust stroke of the engine and the inlet stroke of the engine.

16. The method according to claim 10, wherein in step a), there are two exhaust valves per cylinder that are controlled with the at least one second camshaft.

17. The method according to claim 10, wherein in step a), the at least one exhaust valve is controlled with two second camshafts.

18. The method according to claim 10, further comprising:

stopping or reducing an amount of fuel being supplied to the at least one cylinder via control of a fuel injection device.

19. The method according to claim 10, further comprising:

opening and closing the at least one exhaust valve with the decompression device in another transition area between the inlet stroke of the engine and the exhaust stroke of the engine, when the piston is at the top dead center in the at least one cylinder.

20. The combustion engine according to claim 1, wherein said decompression device is located on said at least one second camshaft.

* * * * *